US009086025B2

(12) United States Patent
Vyas et al.

(10) Patent No.: US 9,086,025 B2
(45) Date of Patent: Jul. 21, 2015

(54) SYSTEMS AND METHODS FOR CORRECTING MASS AIRFLOW SENSOR DRIFT

(71) Applicant: Cummins Inc., Columbus, IN (US)

(72) Inventors: Ashwin Vyas, Columbus, IN (US); Vivek A. Sujan, Columbus, IN (US); Andrew W. Osburn, Nashville, IN (US); Abdul Ofoli, Columbus, IN (US); Govindarajan Kothandaraman, Columbus, IN (US); Karim Azizou, Greenwood, IN (US)

(73) Assignee: Cummins Inc., Columbus, IN (US)

( * ) Notice: Subject to any disclaimer, the term of this patent is extended or adjusted under 35 U.S.C. 154(b) by 341 days.

(21) Appl. No.: 13/646,891

(22) Filed: Oct. 8, 2012

(65) Prior Publication Data

US 2013/0131955 A1 May 23, 2013

Related U.S. Application Data

(60) Provisional application No. 61/562,132, filed on Nov. 21, 2011.

(51) Int. Cl.

| | |
|---|---|
| ***F02D 41/18*** | (2006.01) |
| ***F02D 41/00*** | (2006.01) |
| ***F02D 41/24*** | (2006.01) |
| *F02D 41/22* | (2006.01) |

(52) U.S. Cl.

CPC ..... *F02D 41/0002* (2013.01); *F02D 41/18* (2013.01); *F02D 41/2474* (2013.01); *F02D 41/222* (2013.01)

(58) Field of Classification Search

CPC ..... F02D 41/0002; F02D 41/18; F02D 41/22; F02D 41/222

USPC ..... 123/399, 568.17; 701/103, 108, 107; 73/114.31, 114.32

See application file for complete search history.

(56) References Cited

U.S. PATENT DOCUMENTS

| | | | | |
|---|---|---|---|---|
| 5,070,846 | A | 12/1991 | Dudek et al. | |
| 5,720,258 | A * | 2/1998 | Tolkacz et al. | 123/352 |
| 6,370,935 | B1 | 4/2002 | He et al. | |
| 6,999,882 | B2 | 2/2006 | Frie et al. | |
| 7,302,335 | B1 | 11/2007 | Xiao | |
| 7,444,852 | B2 | 11/2008 | Fokkelman et al. | |

FOREIGN PATENT DOCUMENTS

WO WO 2008/079821 A1 7/2008

* cited by examiner

*Primary Examiner* — Hai Huynh

(74) *Attorney, Agent, or Firm* — Taft Stettinius & Hollister LLP

(57) ABSTRACT

Systems and methods for correcting mass airflow sensor drift include an operation conditions module to interpret a base calibration function, a MAF sensor input value, and a current operating condition. A MAF correction module determines an expected MAF value in response to the current operating condition and a predetermined operating condition. The MAF correction module will also determine an adjusted MAF value in response to the expected MAF value, the base calibration function, and the MAF sensor input value. A MAF reporting module is structured to provide the adjusted MAF value.

27 Claims, 9 Drawing Sheets

SYSTEMS AND METHODS FOR CORRECTING MASS AIRFLOW SENSOR DRIFT

CROSS-REFERENCE TO RELATED APPLICATIONS

The present application claims the benefit of the filing date of provisional application No. 61/562,132 filed on Nov. 21, 2011, which is incorporated herein by reference.

BACKGROUND

The technical field generally relates to systems, methods and devices for determining air flow into an internal combustion engine and for correcting mass airflow sensor drift.

Internal combustion engines have forced induction systems that include a significant amount of plumbing for the air intake assembly prior to the air intake manifold. Mass airflow sensors are known to be employed in the air intake assembly plumbing to provide mass airflow readings that are used in engine and exhaust gas recirculation controls. Mass airflow sensors are known to be susceptible in maintaining accuracy in their output readings over the life of the engine.

The drift error in sensor readings may occur due to sensor aging, sensor contamination, or upstream plumbing changes. Algorithms have been developed for calculating and updating correction factors of a correction factor table of flow values over time when the algorithm is run at or near particular flow values of the table. While these correction techniques can be effective for relatively small changes in the drift error, their effectiveness is limited when conditions occur that cause large changes in the drift error, such as when revisions are made in the air intake plumbing or a filter is changed. In addition, these correction techniques require longer times to correct for drift error, which as a result creates larger errors in mass airflow readings and consequently less effective engine and EGR control when based on these mass airflow readings. Therefore, further technological developments are desirable in this area.

SUMMARY

One embodiment is a unique system and method of correction for mass airflow sensor drift using the parametric characteristics of a sensor transfer function. Other embodiments include unique methods, systems, and apparatus for mass airflow sensor correction when sensor drift exceeds a predetermined threshold, providing rapid correction for substantial drift errors. Further embodiments, forms, objects, features, advantages, aspects, and benefits shall become apparent from the following description and drawings.

DESCRIPTION OF THE ILLUSTRATIVE EMBODIMENTS

Figure 1:
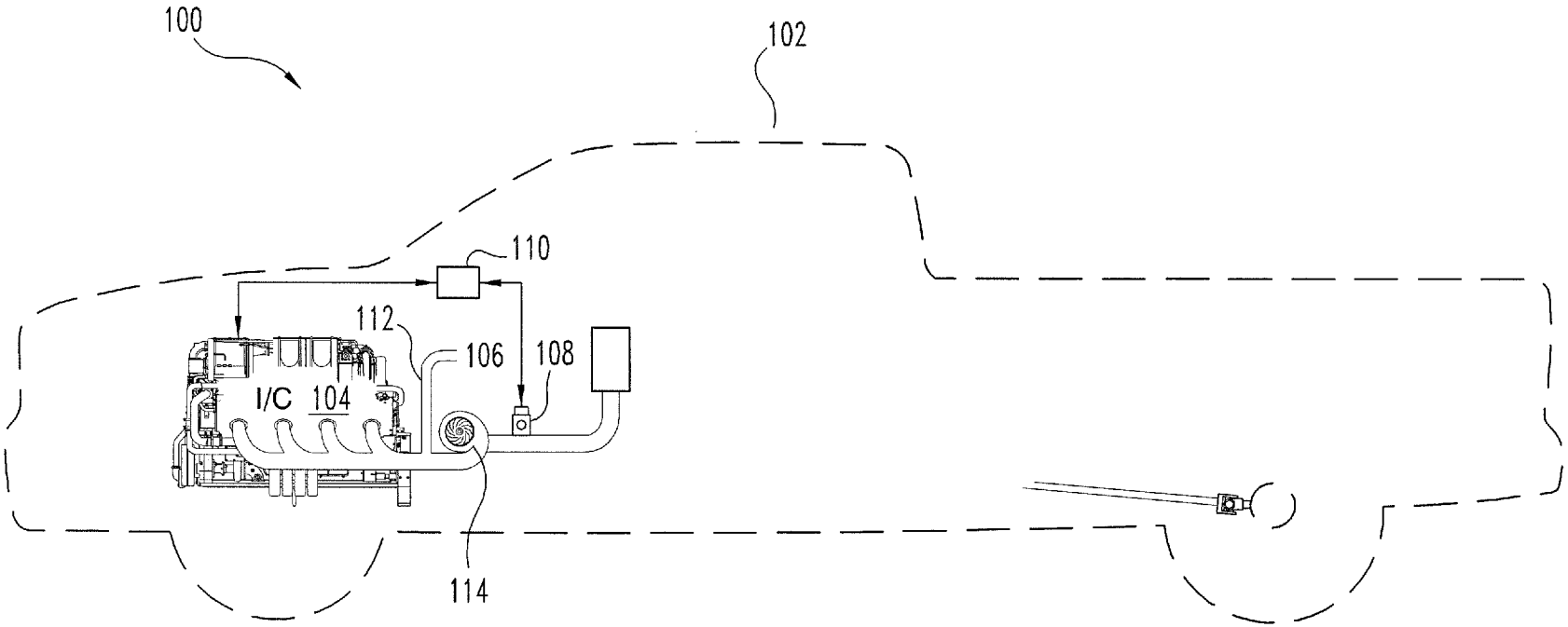
FIG. 1 is a schematic block diagram for a system for mass airflow sensor correction.

For the purposes of promoting an understanding of the principles of the invention, reference will now be made to the embodiments illustrated in the drawings and specific language will be used to describe the same. It will nevertheless be understood that no limitation of the scope of the invention is thereby intended, and any alterations and further modifications in the illustrated embodiments, and any further applications of the principles of the invention as illustrated therein as would normally occur to one skilled in the art to which the invention relates are contemplated herein.

In an exemplary embodiment, a system 100 includes a vehicle 102 which receives traction power from an internal combustion engine 104. The internal combustion engine 104 has an air intake assembly 106 configured to provide air to the internal combustion engine 104. An exemplary internal combustion engine 104 is a diesel engine having an exhaust gas recirculation (EGR) inlet 112 coupled to the air intake assembly 106 downstream of a mass airflow (MAF) sensor 108. However, it is further contemplated that the internal combustion engine 104 may be a gasoline engine, an ethanol engine, a natural gas engine, and/or any other internal combustion engine 104 known to one of ordinary skill in the art. An EGR system transfers a portion of exhaust from an exhaust stream exiting the internal combustion engine 104 to the EGR inlet 112.

The air intake assembly 106 may include an air filter, plumbing which may include bends and/or elbows, baffles, and/or any other device which may be included in an air intake assembly 106 as is known to one of ordinary skill in the art. The MAF sensor 108 is coupled to the air intake assembly 106 in any suitable location and configuration that allows the MAF sensor 108 to determine the amount of air flowing through the air intake assembly 106 into the internal combustion engine 104. The MAF sensor 108 may output a MAF communication, a voltage, a frequency, an analog signal, a digital signal and/or any other output that the controller 110 may utilize to determine a MAF.

In certain embodiments, the air intake assembly 106 includes a turbocharger 114. The turbocharger 114 has a compressor inlet that receives air from the air intake assembly 106. The turbocharger 114 increases the air pressure within the air intake assembly 106 downstream of the turbocharger 114. The turbocharger 114 may be a single scroll turbocharger, a twin scroll turbocharger, a variable geometry turbocharger, and/or any other turbocharger known to one of ordinary skill in the art. In an exemplary embodiment, there may be multiple turbochargers in series, parallel, or a series/parallel hybrid system. An exemplary MAF sensor 108 is positioned upstream of the compressor inlet of the turbocharger 114. In a further exemplary embodiment, the EGR inlet 112 is located downstream of the compressor inlet of the turbocharger 114.

Exemplary MAF sensors 108 include hot-film and hot-wire type MAF sensors. However, it is contemplated that any MAF sensor that determines a MAF through the relationship of temperature to the air flow may be utilized. In an exemplary embodiment, the relationship between a MAF sensor output frequency to air flow transfer function is the exponential function $\dot{m}=A\exp(kf)$, where $\dot{m}$ in is the mass airflow rate, k is an inherent constant value for a given sensor and independent of installation variations, A is a variable that changes as flow conditions change, and f is the MAF sensor output which in this exemplary embodiment is a frequency.

Using the mass air flow transfer function, variable A is the only unknown in the transfer function relating a mass airflow rate to the MAF sensor output. As discussed further below, since the slopes k of the log of the mass airflow rates versus frequency of the MAF sensor output are substantially the same for various plumbing configurations (see FIGS. 4A and 4B), it can be assumed that the slope k is constant for a given MAF sensor and is independent of installation variations associated with the intake plumbing.

The mass airflow transfer function can be used to establish a base calibration function from which a value for $A_o$ can be determined for an expected mass airflow rate at a predetermined operating condition. A subsequent mass airflow rate determined from a signal of MAF sensor 108 at the predetermined operating condition can then be compared to the expected mass airflow rate from the base calibration function. Should the subsequent mass airflow rate deviate from the expected mass airflow rate by more than a predetermined threshold amount due to, for example, changes in plumbing conditions due to service or installation events, the mass airflow rate can be corrected for drift of MAF sensor 108. A value for $A_D$ can be determined since $\dot{m}=A_D\exp(k_o f)$, and then the subsequent mass airflow rate can be multiplied by a correction factor determined by the ratio of $A_D$ to $A_o$ to obtain a mass airflow rate corrected for sensor drift determined from a single mass airflow input. For large corrections of, for example, more than 5%, the base calibration function used to determine the mass airflow rate from sensor readings can be globally shifted by the correction factor so that subsequent mass airflow measurements determined from the base calibration function are more closely and quickly aligned with expected mass airflow rates for a given operating condition. For smaller corrections that, for example, exceed the acceptable uncertainty associated with the sensor inputs, but are less than a threshold indicating a global correction, corrections to the base calibration function are limited to the point or areas of the base calibration function aligned with the measurement in which the drift error occurred.

In certain embodiments, the system 100 further includes a controller 110 structured to perform certain operations for MAF sensor 108 drift correction. In certain embodiments, the controller 110 forms a portion of a processing subsystem including one or more computing devices having memory, processing, and communication hardware. The controller 110 may be a single device or a distributed device, and the functions of the controller may be performed by hardware or software.

In certain embodiments, the controller 110 includes one or more modules structured to functionally execute the operations of the controller 110. In certain embodiments, the controller 110 includes: 1) an operation conditions module 202 that interprets a base calibration function, a MAF sensor input value, and a current operating condition; 2) a MAF correction module 204 that determines an expected MAF value in response to the current operating condition and a predetermined operating condition, and determines an adjusted MAF value in response to the expected MAF value, the base calibration function, and the MAF sensor input value; and 3) a MAF reporting module 206 that provides the adjusted MAF value. The description herein including modules emphasizes the structural independence of the aspects of the controller, and illustrates one grouping of operations and responsibilities of the controller. Other groupings that execute similar overall operations are understood within the scope of the present application. Modules may be implemented in hardware and/or software on computer readable medium, and modules may be distributed across various hardware or software components. More specific descriptions of certain embodiments of controller operations are included in the section referencing FIG. 2. Certain operations described herein include interpreting one or more parameters.

Interpreting, as utilized herein, includes receiving values by any method known in the art, including at least receiving values from a datalink or network communication, receiving an electronic signal (e.g. a voltage, frequency, current, or PWM signal) indicative of the value, receiving a software parameter indicative of the value, reading the value from a memory location on a computer readable medium, receiving the value as a run-time parameter by any means known in the art, and/or by receiving a value by which the interpreted parameter can be calculated, and/or by referencing a default value that is interpreted to be the parameter value.

Figure 2:
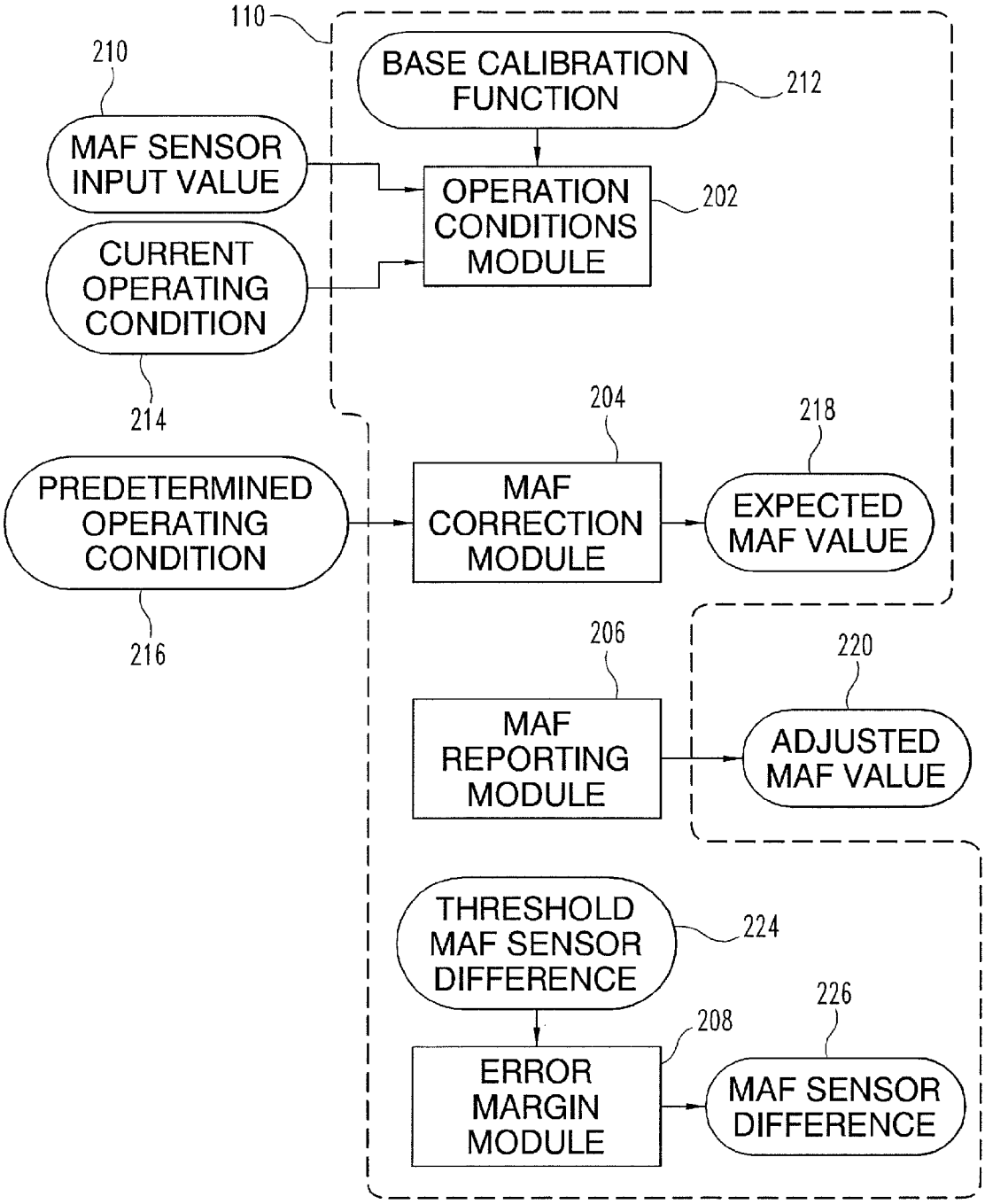
FIG. 2 is a schematic view of a controller that functionally executes certain operations for mass airflow sensor correction.

FIG. 2 is a schematic view of the controller 110 that functionally executes certain operations for MAF sensor correction. The controller 110 includes an operation conditions module 202 that interprets a base calibration function 219, a MAF sensor input value 210, and a current operating condition 214.

Figure 4A:
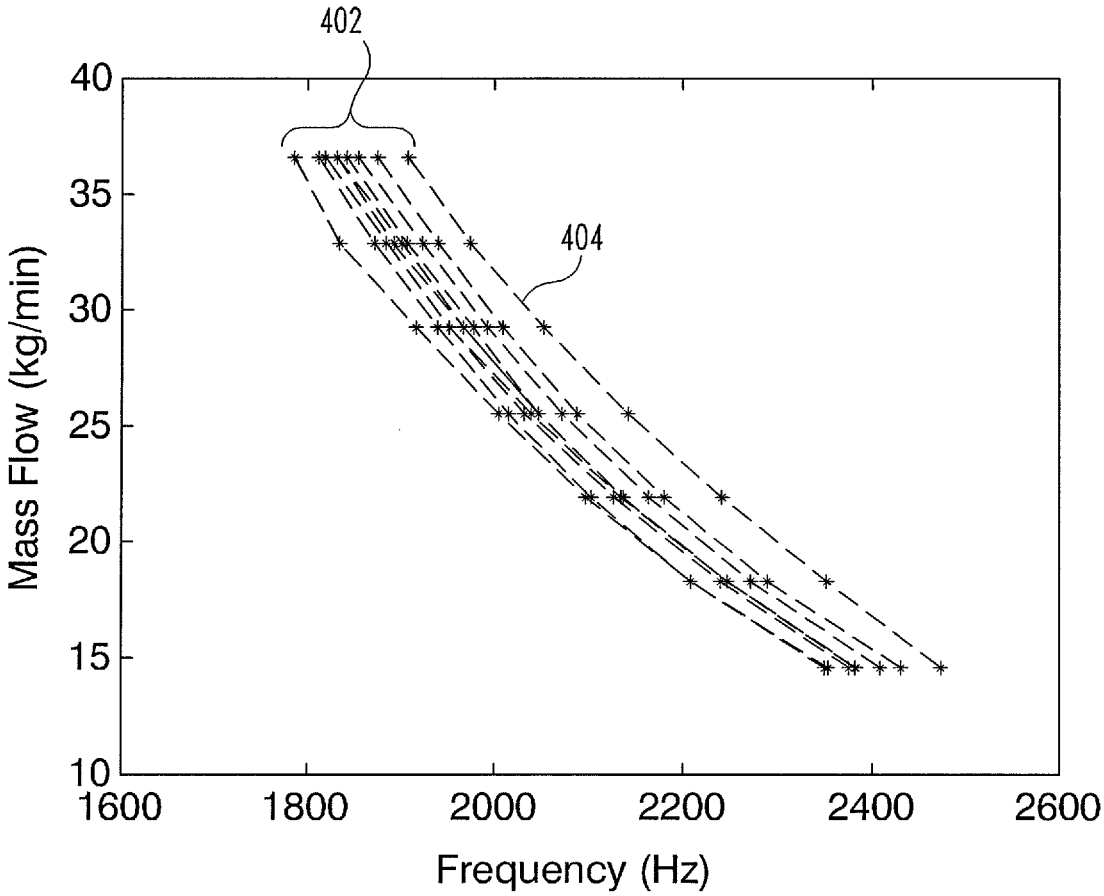
FIG. 4A is illustrative flow bench data for various plumbing configurations.

The base calibration function 219 may be a look-up table, an equation or any other function and/or model to correlate a MAF sensor input value 210 to a MAF. The base calibration function 219 may be stored within the controller 110 and/or communicated to the controller 110. The base calibration function 219 may be a nominal model including a base set of flow values and MAF values. A set of exemplary base calibration functions 402, corresponding to various plumbing configurations, is shown in FIG. 4A. An exemplary base calibration function 404 for a specific plumbing configuration is illustrated. The base calibration functions 219 are derived by operating the system 100 under a series of predetermined operating conditions 216, reading a MAF sensor input value 210 (shown as a frequency with units Hz) and modeling, calculating, and/or reading the MAF.

The MAF sensor input value 210 includes any value known to one of skill in the art through which the MAF can be determined. In an exemplary embodiment, the MAF sensor input value 210 is a frequency representative of the MAF. In another exemplary embodiment, the MAF sensor 108 sends a MAF sensor input value 210 to the controller 110. The controller 110 will determine a MAF in response to the MAF sensor input value 210. Non-limiting examples of the MAF sensor input value 210 include a voltage, a frequency, an analog signal, a digital signal, and/or any other output of the MAF sensor 108 that the controller 110 can determine a MAF in response to.

In a further exemplary embodiment, the MAF sensor input value 210 is an electronic value, a software interpretable value, and/or a datalink value.

Figure 5:
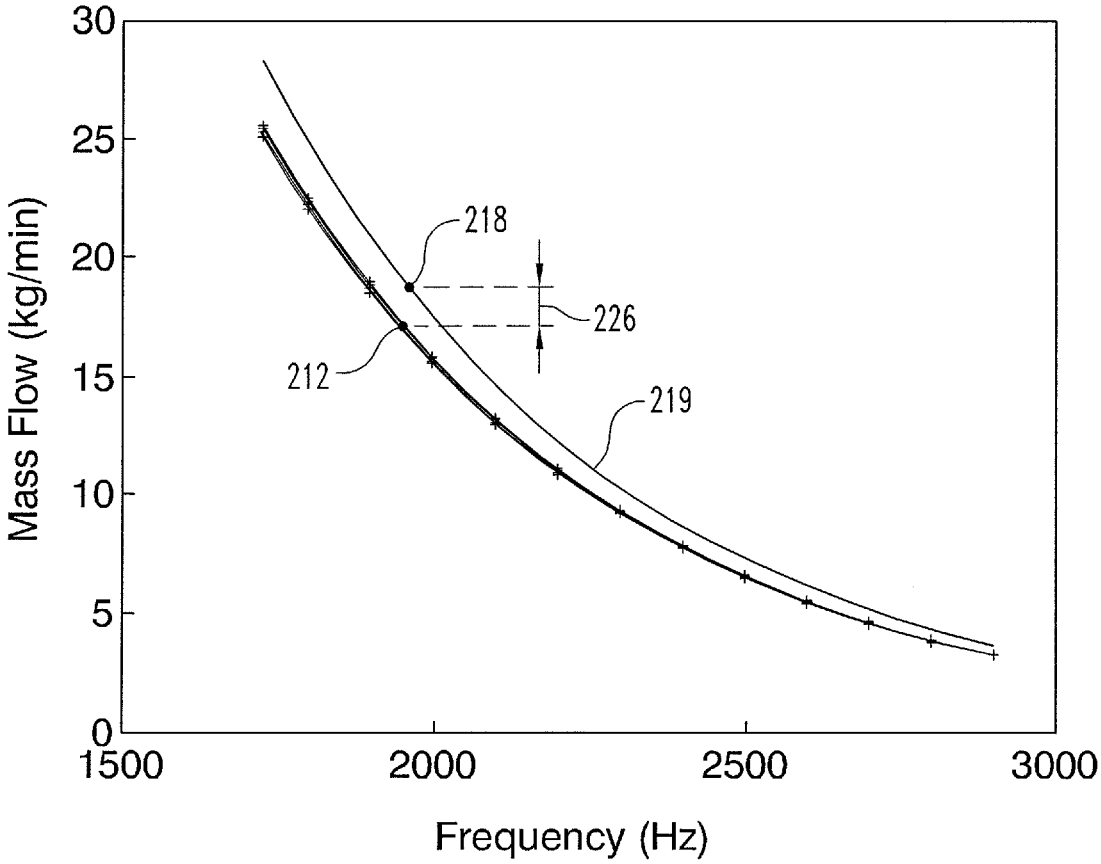
FIG. 5 is an illustrative plot of a base calibration function and an expected MAF value function.

FIG. 5 is an illustrative plot of an exemplary base calibration function 219 and a shifted MAF calibration function 212. The exemplary MAF sensor input value 210 is in the form of a frequency. The points along the exemplary base calibration function 219 are points at which the frequency and MAF are known, through testing, for a predetermined operating condition 216. In the exemplary embodiment, the MAF sensor input value 210 is a frequency sent from the MAF sensor 108 (or a frequency sent from the controller 110 in response to the MAF sensor 108) which is used to determine an expected MAF value 218 through the exemplary base calibration function 219. As can be seen in FIG. 5, the shifted calibration function 212 includes a spread that represents an uncertainty in the reference MAF measurement used to establish the shifted calibration function 212.

The controller 110 includes a MAF correction module 204 that determines an expected MAF value 218 in response to the current operating condition 214 and further in response to a predetermined operating condition 216. An exemplary predetermined operating condition 216 is any defined set of conditions which may be correlated to a particular MAF. The predetermined operating condition 216 may be a point at which a MAF is known. The predetermined operating condition 216 may be any parameter to relate a current operating condition 214 to a MAF. Exemplary embodiments of the predetermined operating condition 216 include, but are not limited to, an engine speed, an engine load, a charge flow (or model thereof) and/or any other parameter through which a MAF is known. In one specific embodiment, the predetermined operating condition includes an exhaust recirculation valve is being closed to prevent exhaust gas recirculation.

One of ordinary skill in the art will understand from this disclosure that to have a current operating condition 214 sufficiently similar to a predetermined operating condition 216 is dependent upon the overall accuracy and/or precision desired. Non-limiting examples of the predetermined operating condition 216 include the internal combustion engine 104 maintaining 1800 RPM over a two second interval, the internal combustion engine 104 producing three hundred units of torque over a three second interval. It should be understood that 1800 RPM is merely one exemplary predetermined operating condition 216 that may be correlated to a MAF. One of ordinary skill in the art, with the aid of this disclosure, will understand that 1800 RPM may not only include 1800 RPM; a range between 1750-1850 RPM, 1725-1825 RPM, and/or 1705-1805 RPM, depending on the accuracy and/or precision required generally to correlate the predetermined operating condition 216 to a current operating condition 214 which will be correlated to a MAF, may be utilized. In other embodiments, the engine speed from idle to governor speed may be the predetermined operating condition 216. Exemplary engine speeds include 500-3200 RPM, 600-2200 RPM, and/or 1175-1425 RPM.

In an exemplary embodiment, the current operating condition 214 includes any parameter that may be correlated to a predetermined operating condition 216 to determine an expected MAF value 218 from base calibration function 219. It should be understood that the current operating condition 214 and the predetermined operating condition 216 may be in the same units; however, the predetermined operating condition 216 and current operating condition 214 need not be in the same units. The current operating condition 214 may be the same operational parameter as the predetermined operating condition 216 or may be a parameter and/or value to correlate to the predetermined operating condition 216. An exemplary current operating condition 214 is a current fuel consumption from which an expected MAF value 218 may be determined through a correlation with a predetermined operating condition 216 of the torque measured at the transmission shaft.

One exemplary current operating condition 214 exists at an engine idle, engine idle being defined by a predetermined engine speed and/or engine load with the exhaust gas recirculation valve closed. Further exemplary non-limiting examples of current operating condition 214 include, but are not limited to, an engine speed, an engine load, an engine temperature, a charge flow (or model thereof), and/or any other engine parameter known to one of ordinary skill in the art which may be correlated to a predetermined operating condition 216 to determine an expected MAF value 218. Further non-limiting examples of current operating condition 214 include internal combustion engine 104 producing three hundred units of torque for approximately two seconds, internal combustion engine 104 maintaining an RPM sufficiently close to 1300 for one second, and/or any other engine parameter which may be correlated to a predetermined operating condition 216 to determine an expected MAF value 218.

Referring back to FIG. 5, the base calibration function 219 is illustrated with a plurality of predetermined MAF values which correspond to predetermined operating conditions 216. The expected MAF value 218 is shown as a point; however, the expected MAF value 218 is further depicted as base calibration function 219 based on the predetermined operating conditions. The difference 226 between the shifted calibration function 212 and base calibration function 219 can result, for example, due to installation changes, sensor changes, or changes in location of the sensor. An exemplary MAF sensor difference 226 is also illustrated in FIG. 5. MAF sensor difference 226 exemplifies that a measured MAF value has shifted from the expected MAF value 218 derived from base calibration function 219 for the given frequency at the current operating condition 214 correlated to a predetermined operating condition 216. In an exemplary embodiment, an exemplary MAF sensor difference 226 between the expected MAF value 218 and the exemplary shifted calibration function 212 increases as the MAF increases.

In an exemplary embodiment, the expected MAF value 218 is the MAF value predicted to result from the MAF sensor input value 210 and base calibration function 219 in response to the current operating condition 214. The expected MAF value 218 will approximate the MAF sensor input value 210 when a MAF sensor correction factor is 1. In a further exemplary embodiment, the current operating condition 214 is compared to the predetermined operating condition 216. Referring to FIGS. 4A and 5, the predetermined operating conditions 216 dictate the points along the base calibration function 219. The current operating condition 214 may pass through one of these predetermined points; however, the current operating condition 214 most likely will not coincide with the predetermined operating condition 216. In an exemplary embodiment, the closest predetermined operating condition 216, and corresponding flow value, to the current operating condition 214 may be utilized. In another embodiment, the expected MAF values are interpolated between the closest predetermined operating conditions 216. In an exemplary embodiment, the current operating condition 214 flow conditions are sufficiently similar to the predetermined operating condition 216 flow conditions such that a comparison can be made. If greater accuracy and/or precision for the model is desired, the more similar the flow conditions of the predetermined operating condition 216 and the current operating condition 214 need to be.

In another exemplary embodiment, an error between a flow at a predetermined operating condition 216 and a flow at the current operating condition 214 may be calculated. The error between the flow of the predetermined operating condition 216 and the flow of the current operating condition 214 may be utilized to determine if a measured flow is sufficiently similar to a predetermined flow for the operating condition. In a further exemplary embodiment, a flow for a predetermined operating condition 216 may contain an acceptable error. In this embodiment, when a flow of a current operating condition 214 falls within the acceptable error of the flow of the predetermined operating condition 216, the flow of the predetermined operating condition 216 may be used as a default flow and no correction is made since the measured flow falls within acceptable limits of uncertainty associated with the measurement. As the MAF threshold sensor difference 224 decreases, the accuracy and/or precision of the rest of the model must increase so that the threshold MAF sensor difference 224 may be satisfied.

A change in ambient temperature and/or compressor inlet temperature may alter the MAF. The predetermined operating condition 216 and/or the base calibration function 219 may be altered to account for the change in ambient temperature. The MAF correction module 204 further determines an adjusted MAF value 220 in response to the expected MAF value 218, the base calibration function 219, and the MAF sensor input value 210. In an exemplary embodiment, the adjusted MAF value 220 is determined by correcting the MAF sensor input value 210 in response to the expected MAF value 218 and the base calibration function 219.

In further exemplary embodiments, the adjusted MAF value 220 may be determined by multiplying the MAF sensor input value 210 by a correction factor, altering the output of MAF sensor 108 to adjust the MAF sensor input value 210, averaging a series of adjusted MAF values 220 which have been stored over time, and/or utilizing a MAF sensor input value 210 which is the closest MAF value to the adjusted MAF value 220 that system 100 can operably function at. In an exemplary embodiment, the adjusted MAF value 220 may be approximately equal to the expected MAF value 218. In further exemplary embodiments, the adjusted MAF value 220 may be determined by globally shifting the adjusted calibration function 212 in response to a MAF sensor input value 210 to move toward the adjusted MAF value 220, utilizing an offset table, and/or utilizing a step and/or filtered response value. Through the use of a filtered response value, the measured MAF value may be moved over a period of steps toward the expected MAF value, wherein in each step the adjusted MAF value 220 is only a fraction of the way between the measured MAF value as determined from the MAF sensor input value 210 and the expected MAF value 218 at the current operating conditions.

The controller 110 further includes a MAF reporting module 206 that provides the adjusted MAF value 220. In an exemplary embodiment, the internal combustion engine 104 may be operated with the adjusted MAF value 220 or a derivation thereof. An exemplary system 100 further includes the controller 110 having an error margin module 208 that interprets a threshold MAF sensor difference 224 and determines a MAF sensor difference 226 in response to the expected MAF value 218 and the measured MAF value. The MAF reporting module 206 further provides the adjusted MAF value 220 in response to the MAF sensor difference 226 exceeding the threshold MAF sensor difference 224.

Figure 6A:
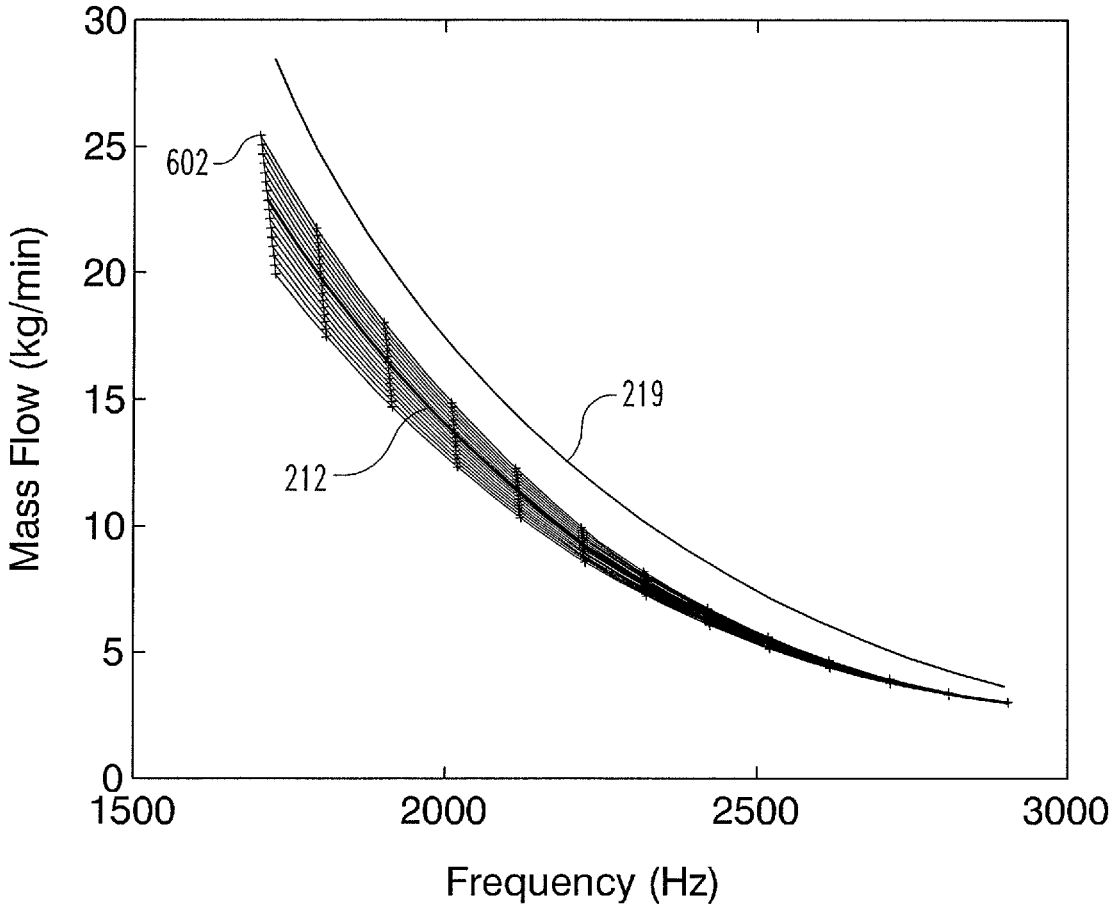
FIG. 6A is an illustrative plot of a MAF sensor difference of −20%.
Figure 6B:
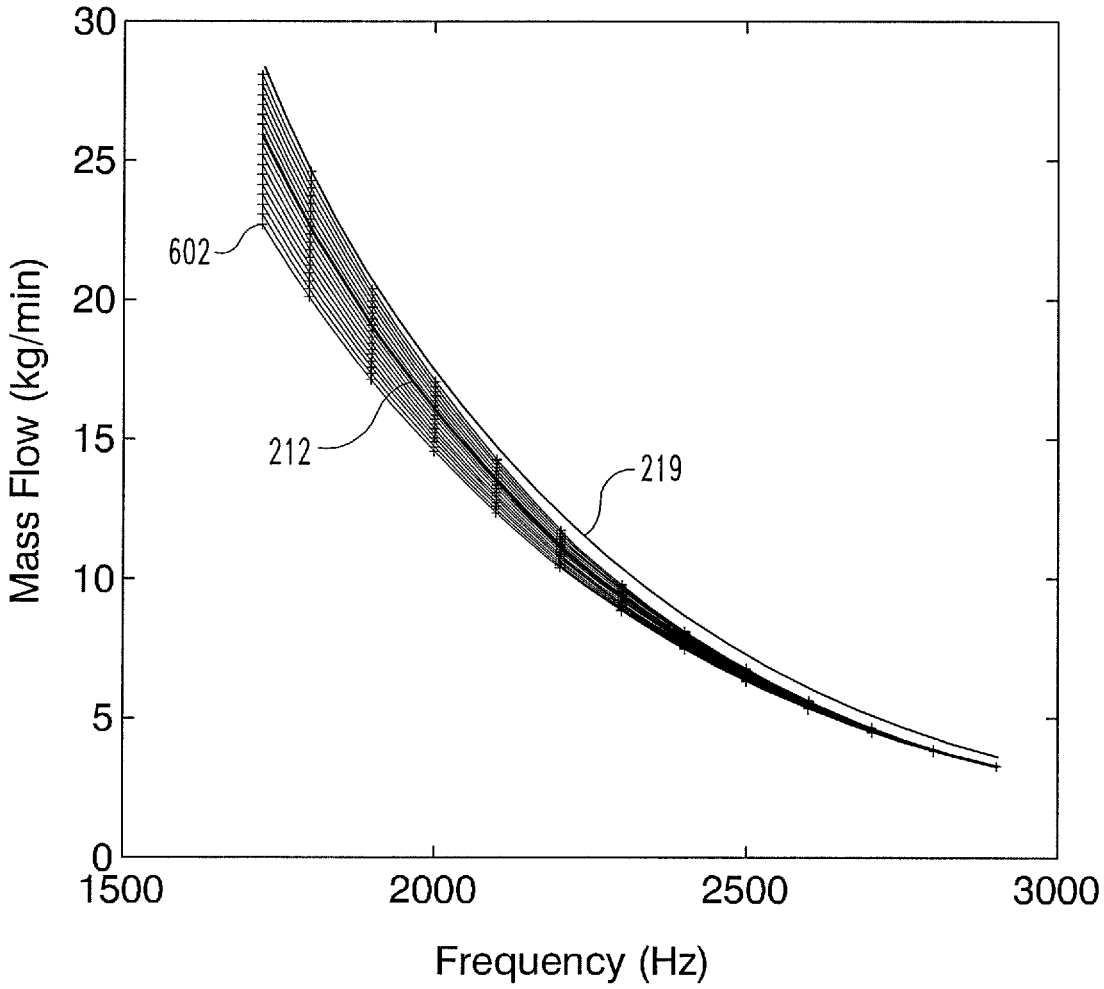
FIG. 6B is an illustrative plot of a MAF sensor difference of −10%.

FIGS. 6A and 6B illustrate additional exemplary MAF sensor differences 226 and threshold MAF sensor differences 224. In exemplary embodiments, the threshold MAF sensor difference 224 is a function of the current operating condition 214.

FIG. 6A is an illustrative plot of a MAF sensor difference 226 of −20%. The shifted calibration function 212 is globally shifted from base calibration function 219 and includes uncertainty 602 to show the bounds for the actual MAF along shifted calibration function 212. Shifted calibration function 212 is shifted based on an actual MAF measurement deviating from an expected MAF value 218 at the current operating conditions by a predetermined threshold. In the example of FIG. 6A, the sensor difference 226 is based on a MAF reading at around 3000 Hz. Thus, the uncertainty 602 increases as the shifted calibration function 212 moves away from the operating point at which the sensor difference 226 was determined. In the illustrated embodiment, the sensor difference of −20% is based on the difference between the expected MAF value at the current operating conditions and the reading from the MAF sensor, corrected by the last correction table update. Uncertainty 602 can be calculated by a variation analysis with the estimated variation of the slope, the reference measurement for the expected MAF value 218, and the non-linear nature of sensor drift. Due to the large MAF sensor difference 226, the shifted calibration function 212 provides a better estimate of the correction required to the measured MAF values at all operating points along base calibration function 219, even with uncertainty 602 increasing at operating points far away from point upon which the adjustment was based. In one embodiment, if the threshold MAF sensor difference 224 is −5% or more, an adjusted MAF value 220 will be provided for operation of the internal combustion engine 104 in response to the corrections to the MAF measurement indicated by shifted calibration function 212 with included uncertainty 602.

FIG. 6B is an exemplary plot of a MAF sensor difference 226 of −10%. The shifted calibration function 212 with included uncertainty 602 and the base calibration function 219 are shown. If the threshold MAF sensor difference 224 is −10% or less, an adjusted MAF value 220 may not be provided for operation of the internal combustion engine 104 in response to the shifted calibration function 212 since the included uncertainty 602 overlaps the base calibration function 219. However, the threshold varies by system and it is believed that a threshold of more than 5% can indicate a global shift in the base calibration function 219. In the embodiment of FIG. 6B, the internal combustion engine may ignore the adjusted MAF value 220. The percentage of the threshold MAF sensor difference 224 may decrease as the accuracy of the model used to determine the expected MAF value 218 increases. As is illustrated in FIG. 6B, in an exemplary embodiment, should the uncertainty 602 of the shifted calibration function 212 be greater than the MAF sensor difference 226, the adjusted MAF value 220 may not be used.

Exemplary values for the MAF sensor difference 226 include at least 5% of the expected MAF value 218, at least 10% of the expected MAF value 218, a value between 5% and 35% of the expected MAF value, 218 a value between 5% to 50% of the expected MAF value 218, and/or a value between 5% and 100% of the expected MAF value 218. In certain embodiments, a fault counter is activated for MAF sensor difference of more than 40% and a fault is reported after a certain count threshold is reached. It is also contemplated that the MAF sensor difference 226 includes any percentage of the expected MAF value 218. Significant plumbing changes may result in gross MAF sensor differences 226 in which a global shift of the base calibration function 219 is made. On the other hand, sensor drift may result in very small MAF sensor differences 226 in which no adjustment of base calibration function 219 is made, or in which only local adjustments of base calibration function 219 is made at points near the measurement. Furthermore, it must be understood that the MAF sensor difference 226 may be expressed as a percentage, a number, a function, and/or any other method known to one of ordinary skill in the art to quantify a difference between an expected MAF value 218 and a base calibration function 219.

Figure 4B:
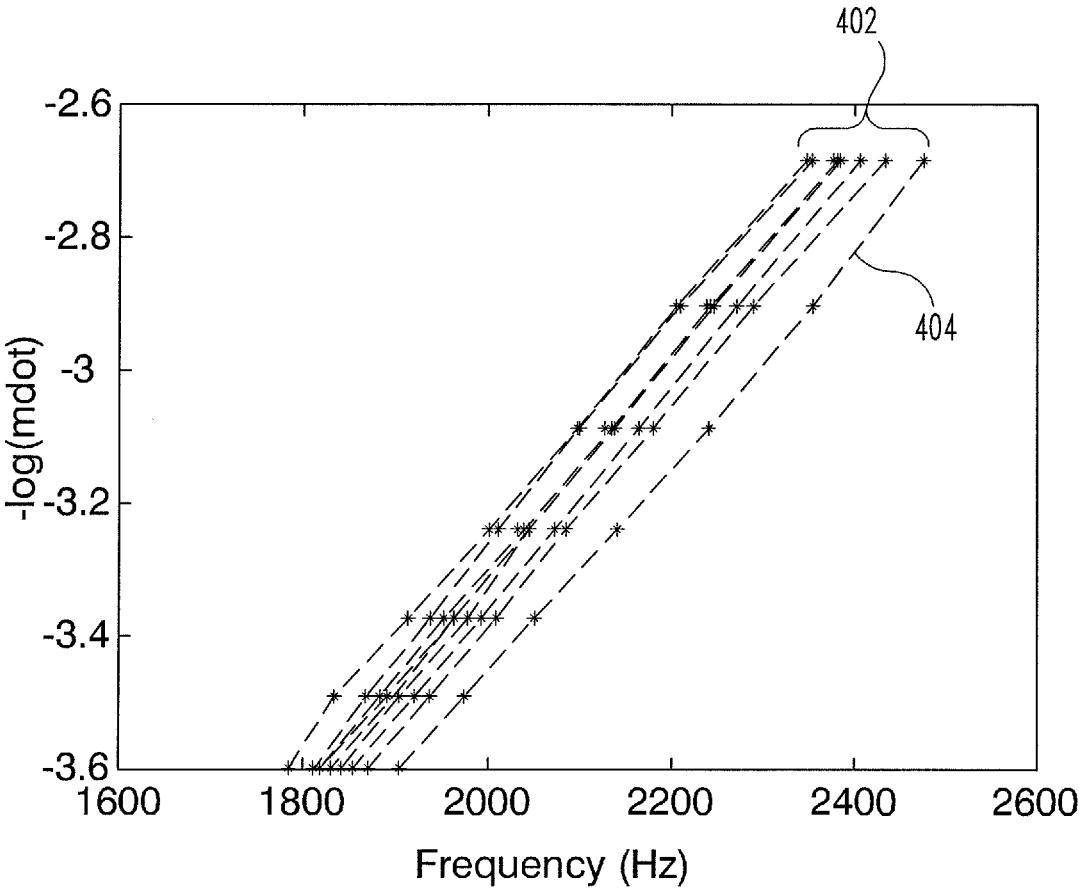
FIG. 4B is the log plot of FIG. 4A.

In an exemplary embodiment, the sign convention of the MAF sensor difference 226 may be ignored when comparing to a threshold MAF sensor difference 224. In another exemplary embodiment, the sign convention of the MAF sensor difference 226 may be utilized during this comparison and carried through to the determination of the adjusted MAF value 220. In an exemplary embodiment, a log plotted slope of a number of MAF sensor input values 210 differs from a log plotted slope of the adjusted base calibration function 212 and a log plotted slope of the base calibration function 219. FIG. 4B is the log plot of FIG. 4A. In certain exemplary embodiments, the slopes of the logs of the various base calibration functions 219 approximate each other and are approximately linear. As is illustrated in FIG. 4B, the log of exemplary base calibration functions corresponding to various plumbing configurations 402 are approximately linear.

Exemplary embodiments of considerations for determining if a log of base calibration function 219 is approximately linear include but are not limited to: 1) determining that while there is a degree of non-linearity in the base calibration function 219 it may be considered approximately linear if the threshold MAF sensor difference 224 is large enough that the degree of non-linearity in the base calibration function 219 may be considered negligible; 2) determining that an average of slopes at various intervals along the base calibration function 219 may be averaged for an overall slope because the error inherent to this average is deemed negligible when compared to the threshold MAF sensor difference; and 3) determining that the slope of the base calibration function 219 may be considered approximately linear by any means known to one of ordinary skill in the art.

In certain exemplary embodiments, the MAF sensor 108 has experienced a non-linear drift from the base calibration function 219. While there may be a large percent error between the base calibration function 219 and the shifted calibration function 212 during a non-linear drift occurrence, this error may be ignored should the MAF sensor difference 226 exceed the percent error between the base calibration function 219 and the shifted calibration function 212. In other embodiments, the non-linearity may be ignored when the non-linearity error falls within the desired precision and/or accuracy for the total model. In even further embodiments, the non-linearity may be completely ignored.

The schematic flow diagram and related description which follows provides an illustrative embodiment of performing procedures for MAF sensor drift corrections. Operations illustrated are understood to be exemplary only, and operations may be combined or divided, and added or removed, as well as re-ordered in whole or part, unless stated explicitly to the contrary herein. Certain operations illustrated may be implemented by a computer executing a computer program product on a computer readable medium, where the computer program product comprises instructions causing the computer to execute one or more of the operations, or to issue commands to other devices to execute one or more of the operations.

Figure 3A:
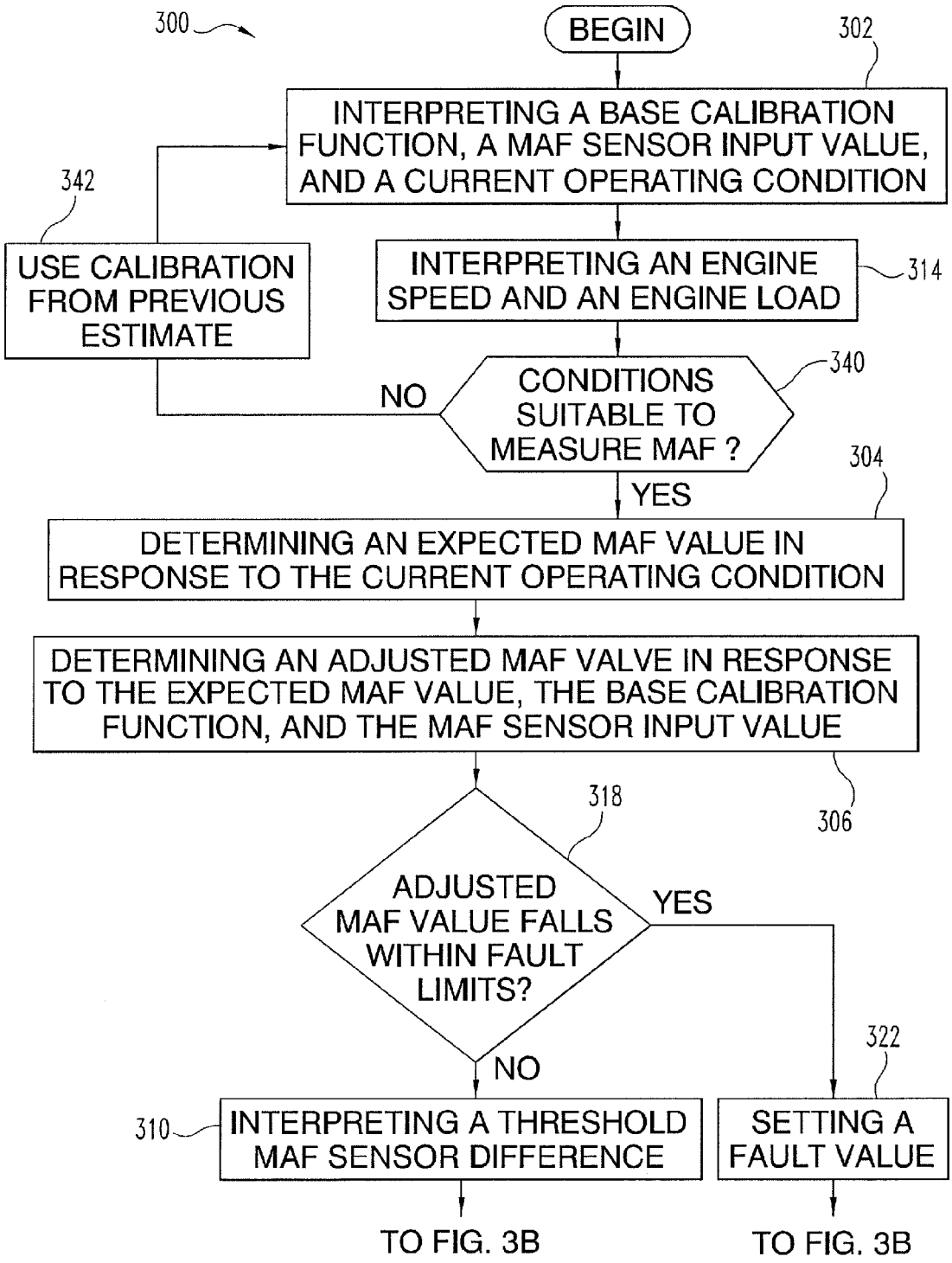
FIGS. 3A and 3B are a schematic flow diagram of a procedure for mass airflow sensor correction.
Figure 3B:
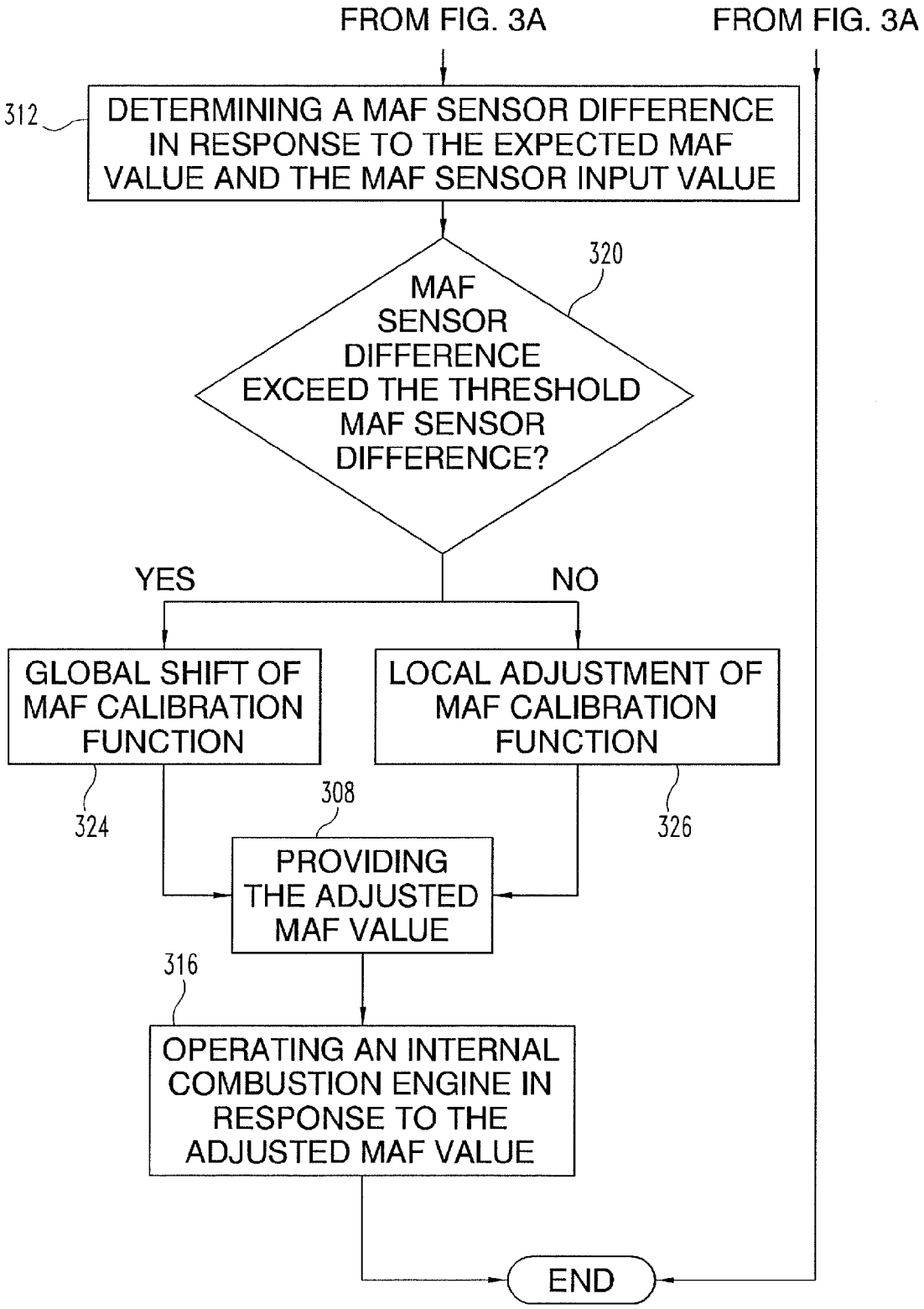

FIGS. 3A and 3B are a schematic flow diagram of a procedure 300 for mass airflow sensor drift correction. In an exemplary embodiment, procedure 300 includes an operation 302 that interprets a base calibration function, a MAF sensor input value, and a current operating condition. A determination operation 340 determines whether conditions are suitable for measurement of a MAF value. Examples of suitable conditions include, for example, the engine operating under a steady-state condition and an EGR valve being closed. If conditions are not suitable for measurement of a MAF value, an operation 342 uses the default calibration function or a base calibration function from a previous estimate. If conditions are acceptable for measuring a MAF value, an operation 304 determines an expected MAF value in response to the current operating condition and a predetermined operating condition. An operation 306 determines an adjusted MAF value in response to the expected MAF value, the base calibration function, and the MAF sensor input value. The procedure 300 further includes operation module 308 that provides the adjusted MAF value.

In certain embodiments, the procedure 300 further includes operation 310 that interprets a threshold MAF sensor difference. An operation 312 determines a MAF sensor difference in response to the expected MAF value and the MAF sensor input value. A determination operation 320 determines if the MAF sensor difference exceeds the threshold MAF sensor difference. If the MAF sensor difference exceeds the threshold MAF sensor difference, the operation 324 provides a global shift to adjust the base calibration function and operation 308 provides the adjusted MAF value based on the adjusted base calibration function. If the MAF sensor difference does not exceed the threshold MAF sensor difference, an operation 326 provides local adjustment of the base calibration function at a point or points near the measurement and operation 308 provides the adjusted MAF value. In yet another embodiment, if the MAF sensor difference is sufficiently small, local adjustments may not be made and the MAF value reverts to a previously estimated MAF value for the operating condition and no adjustment of the base calibration function is made. In certain further embodiments, the procedure 300 includes interpreting the threshold MAF sensor difference in response to the current operating condition.

An exemplary procedure 300 includes an operation 314 interpreting an engine speed and an engine load. An operation 316 includes operating an internal combustion engine in response to the adjusted MAF value. Yet another exemplary embodiment includes determination operation 318 that determines if the adjusted MAF value falls within a set of fault limits. These fault limits could include a percentage, a numerical value, a function, and any other fault limit known to one of ordinary skill in the art to determine if the adjusted MAF value is potentially determined in response to a faulty MAF sensor input (e.g. the MAF sensor has failed). If the adjusted MAF value falls within the fault limits, an operation 322 sets a fault value. The fault value may be stored within controller 110 and may be displayed as a fault code, a fault indicator light, or any other way to store and/or display a fault value as is known to one of ordinary skill in the art.

A further exemplary embodiment includes a determination operation that determines if the MAF sensor difference falls within a set of fault limits after determination operation 320. The fault limits may be defined as aforementioned. If the MAF sensor difference falls within the fault limits, an operation may set a fault value that is provided at operation 308 as the adjusted MAF value. As is evident from the figures and text presented above, a variety of embodiments according to the present invention are contemplated.

An exemplary set of embodiments is a system including an internal combustion engine having an air intake assembly, a mass airflow (MAF) sensor operably coupled to the air intake assembly, and a controller having modules structured to functionally execute operations for correcting the MAF sensor. The controller includes an operation conditions module that interprets a base calibration function, a MAF sensor input value, and a current operating condition. The controller further includes a MAF correction module that determines an expected MAF value in response to the current operating condition and further in response to a predetermined operating condition. The MAF correction module further determines an adjusted MAF value in response to the expected MAF value, the base calibration function, and the MAF sensor input value. In certain situations, the expected MAF value may not be available, in which case the last updated correction factor table value is used. The controller further includes a MAF reporting module that provides the adjusted MAF value.

An exemplary internal combustion engine includes a diesel engine having an exhaust gas recirculation (EGR) inlet operably coupled to the air intake assembly downstream of the MAF sensor. Exemplary MAF sensors include a hot-film MAF sensor or a hot-wire MAF sensor. In certain embodiments, the air intake assembly includes a turbocharger having a compressor inlet, where the MAF sensor is positioned upstream of the compressor inlet.

An exemplary system further includes the controller having an error margin module that interprets a threshold MAF sensor difference and determines a MAF sensor difference in response to the expected MAF value and the MAF sensor input value. The MAF reporting module further provides the adjusted MAF value in response to the MAF sensor difference exceeding the threshold MAF sensor difference. Exemplary values for the MAF sensor difference include at least 5% of the expected MAF value, at least 10% of the expected MAF value, a value between 5% and 35% of the expected MAF value, a value between 5% and 50% of the expected MAF value, and/or a value between 5% and 100% of the expected MAF value.

Another exemplary set embodiments is an apparatus including an operation conditions module that interprets a base calibration function, a MAF sensor input value, and a current operating condition. The apparatus further includes a MAF correction module that determines an expected MAF value in response to the current operating condition and a predetermined operating condition, and further determines an adjusted MAF value in response to the expected MAF value, the base calibration function, and the MAF sensor input value. The apparatus further includes a MAF reporting module that provides the adjusted MAF value. In certain embodiments, the expected MAF value defines an expected MAF function. In certain embodiments, the base calibration function and the expected MAF function are exponential functions.

In certain embodiments, a log plotted slope of a number of MAF sensor input values differs from a log plotted slope of the adjusted MAF base calibration function and a log plotted slope of the base MAF calibration function. In certain embodiments, the MAF sensor has experienced a non-linear drift from the base calibration function.

An exemplary apparatus further includes an error margin module that interprets a threshold MAF sensor difference and determines a MAF sensor difference in response to the expected MAF value and the MAF sensor input value. The MAF reporting module further provides the adjusted MAF value in response to the MAF sensor difference exceeding the threshold MAF sensor difference. In certain embodiments, the threshold MAF sensor difference is a function of the current operating condition.

Yet another exemplary set of embodiments is a method, including interpreting a base calibration function, a MAF sensor input value, and a current operating condition. The method further includes determining an expected MAF value in response to the current operating condition and a predetermined operating condition, and determining an adjusted MAF value in response to the expected MAF value, the base calibration function, and the MAF sensor input value. The method further includes providing the adjusted MAF value.

In certain embodiments, the method further includes interpreting a threshold MAF sensor difference, determining a MAF sensor difference in response to the expected MAF value and the MAF sensor input value, and providing the adjusted MAF value further in response to the MAF sensor difference exceeding the threshold MAF sensor difference. In certain further embodiments, the method includes interpreting the threshold MAF sensor difference in response to the current operating condition.

An exemplary method includes interpreting the current operating condition by interpreting an engine speed and an engine load. Another exemplary method includes operating an internal combustion engine in response to the adjusted MAF value. Yet another exemplary method includes setting a fault value in response to the adjusted MAF value, and/or setting a fault value in response to the MAF sensor difference.

Yet another exemplary set of embodiments is a method including providing an internal combustion engine having an air intake assembly, where the air intake assembly includes a MAF sensor operably coupled thereto, operating the internal combustion engine at one of a number of predetermined operating conditions, and interpreting a current MAF sensor function and a MAF sensor input value. The method further includes determining an expected MAF sensor value, interpreting a threshold MAF sensor difference, and determining a MAF sensor difference in response to the expected MAF sensor value and the MAF sensor input value. The method further includes, in response to the MAF sensor difference exceeding the threshold MAF sensor difference, adjusting a correction factor of the MAF sensor in response to the current MAF sensor function, the MAF sensor input value, and the expected MAF sensor value.

An exemplary method further includes determining an adjusted base calibration in response to the expected MAF sensor value and the measured MAF sensor value. A further exemplary method includes interpreting the MAF sensor input value further by interpreting a relationship between a temperature change value and a mass airflow value. In certain embodiments, interpreting the threshold MAF sensor difference further includes interpreting the threshold MAF sensor difference in response to the one of the number of predetermined operating conditions. Another exemplary method includes operating the internal combustion over a range of operating conditions, where the range of operating conditions further includes the one of the number of predetermined operating conditions.

While the invention has been illustrated and described in detail in the drawings and foregoing description, the same is to be considered as illustrative and not restrictive in character, it being understood that only certain exemplary embodiments have been shown and described and that all changes and modifications that come within the spirit of the inventions are desired to be protected. It should be understood that while the use of words such as preferable, preferably, preferred or more preferred utilized in the description above indicate that the feature so described may be more desirable, it nonetheless may not be necessary and embodiments lacking the same may be contemplated as within the scope of the invention, the scope being defined by the claims that follow. In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A system, comprising:

an internal combustion engine having an air intake assembly;

a mass airflow (MAF) sensor operably coupled to the air intake assembly; and a controller operably connected to the internal combustion engine and the MAF sensor, the controller comprising:

an operation conditions module structured to interpret a base calibration function of the MAF sensor, a MAF sensor input value, and a current operating condition of the internal combustion engine;

a MAF correction module structured to determine an expected MAF value in response to the current operating condition and a predetermined operating condition;

an error margin module structured to interpret a threshold MAF sensor difference and to determine a MAF sensor difference in response to the expected MAF value and the MAF sensor input value;

wherein the MAF correction module is structured to determine an adjusted MAF value in response to the expected MAF value, the base calibration function, the threshold MAF sensor difference, and the MAF sensor input value, wherein the adjusted MAF value is based on a local adjustment of the base calibration function in response to the MAF sensor difference being less than the threshold MAF sensor difference and the adjusted MAF value is based on a global shift of the base calibration function in response to the MAF sensor difference being greater than the threshold MAF sensor difference; and a MAF reporting module structured to provide the adjusted MAF value.

2. The system of claim 1, wherein the internal combustion engine is a diesel engine having an exhaust gas recirculation (EGR) inlet operably coupled to the air intake assembly downstream of the MAF sensor.

3. The system of claim 1, wherein the MAF sensor is one of a hot-film MAF sensor and a hot-wire MAF sensor.

4. The system of claim 1, wherein the air intake assembly includes a turbocharger having a compressor inlet and, wherein the MAF sensor is positioned upstream of the compressor inlet.

5. The system of claim 1, wherein the threshold MAF sensor difference comprises at least 5% of the expected MAF value.

6. The system of claim 1, wherein the threshold MAF sensor difference comprises at least 20% of the expected MAF value.

7. The system of claim 1, wherein the threshold MAF sensor difference comprises a value between 5% and 35% of the expected MAF value.

8. An apparatus, comprising:

an operation conditions module structured to interpret a base calibration function, a MAF sensor input value, and a current operating condition;

a MAF correction module structured to determine an expected MAF value in response to the current operating condition and a predetermined operating condition, and determine an adjusted MAF value in response to the expected MAF value, the base calibration function, and the MAF sensor input value, the MAF correction module further being structured to provide a global shift of the base calibration function when the MAF sensor input differs from the expected MAF value by more than a predetermined threshold, and the MAF correction module is further structured to provide a local adjustment of the base calibration function in response to the MAF sensor input differing from the expected MAF value by less than the predetermined threshold, wherein the adjusted MAF value is based on at least one of the globally shifted base calibration function and the locally adjusted base calibration function; and a MAF reporting module structured to provide the adjusted MAF value.

9. The apparatus of claim 8, wherein the expected MAF value defines an expected MAF function.

10. The apparatus of claim 9, wherein a log plotted slope of a number of MAF sensor input values differs from a log plotted slope of the expected MAF function and a log plotted slope of the base calibration function.

11. The apparatus of claim 9, wherein the base calibration function and the expected MAF function are exponential functions.

12. The apparatus of claim 8, further comprising an error margin module structured to interpret a threshold MAF sensor difference and to determine a MAF sensor difference in response to the expected MAF value and the MAF sensor input value, and wherein the MAF reporting module is further structured to provide the adjusted MAF value in response to the MAF sensor difference exceeding the threshold MAF sensor difference.

13. The apparatus of claim 12, wherein the threshold MAF sensor difference is a function of the current operating condition.

14. The apparatus of claim 12, wherein the threshold MAF sensor difference has a range of 5% to 35% of the expected MAF value.

15. The apparatus of claim 12, wherein the threshold MAF sensor difference has a range of 5% to 50% of the expected MAF value.

16. The apparatus of claim 12, wherein the threshold MAF sensor difference has a range of 5% to 100% of the expected MAF value.

17. A method, comprising:

interpreting a base calibration function, a MAF sensor input value, and a current operating condition;

determining an expected MAF value in response to the current operating condition and a predetermined operating condition;

interpreting a threshold MAF sensor difference;

determining a MAF sensor difference in response to the expected MAF value and the MAF sensor input value;

in response to the MAF sensor difference exceeding the threshold sensor difference, globally shifting the base calibration function, and in response to the MAF sensor difference being less than the threshold MAF sensor difference, determining a local adjustment for the MAF sensor input value;

determining an adjusted MAF value in response to the expected MAF value, one of the globally shifted base calibration function and the local adjustment, and the MAF sensor input value; and providing the adjusted MAF value.

18. The method of claim 17, wherein the interpreting the threshold MAF sensor difference is in response to the current operating condition.

19. The method of claim 17, wherein the interpreting the current operating condition further comprises interpreting an engine speed and an engine load.

20. The method of claim 17, further comprising operating an internal combustion engine in response to the adjusted MAF value.

21. The method of claim 17, further comprising setting a fault value in response to the adjusted MAF value.

22. The method of claim 17, further comprising setting a fault value in response to the MAF sensor difference.

23. A method, comprising:

providing an internal combustion engine having an air intake assembly, the air intake assembly having a MAF sensor operably coupled thereto;

operating the internal combustion engine at one of a plurality of predetermined operating conditions;

interpreting a current MAF sensor function and a MAF sensor input value;

determining an expected MAF sensor value;

interpreting a threshold MAF sensor difference;

determining a MAF sensor difference in response to the expected MAF sensor value and the MAF sensor input value; and in response to the MAF sensor difference exceeding the threshold MAF sensor difference, globally shifting the current MAF sensor function, and in response to the MAF sensor difference being less than the threshold MAF sensor difference, locally adjusting the current MAF sensor function, and determining an adjusted MAF value in response to one of the globally shifted MAF function and the adjusted MAF function, the MAF sensor input value, and the expected MAF sensor value.

24. The method of claim 23, further comprising determining an expected MAF function in response to the expected MAF sensor value, and further adjusting the correction factor of the MAF sensor in response to the expected MAF function.

25. The method of claim 23, wherein interpreting the MAF sensor input value further comprises interpreting a relationship between a temperature change value and a mass airflow value.

26. The method of claim 23, wherein the interpreting the threshold MAF sensor difference further comprises interpreting the threshold MAF sensor difference in response to the one of the plurality of predetermined operating conditions.

27. The method of claim 23, wherein the operating the internal combustion engine at one of the plurality of predetermined operating conditions further comprises operating the internal combustion over a range of operating conditions, where the range of operating conditions further includes the one of the number of predetermined operating conditions.

* * * * *